US006896251B2

(12) United States Patent
Stephan

(10) Patent No.: US 6,896,251 B2
(45) Date of Patent: May 24, 2005

(54) DEVICE FOR SEPARATING MUTUALLY ADJACENT FLAT COPIES

(75) Inventor: Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 203 days.

(21) Appl. No.: 10/042,018

(22) Filed: Jan. 7, 2002

(65) Prior Publication Data

US 2002/0112624 A1 Aug. 22, 2002

(30) Foreign Application Priority Data

Jan. 5, 2001 (DE) ..... 101 00 251

(51) Int. Cl.[7] ..... B65H 5/00
(52) U.S. Cl. ..... 271/9.07; 271/9.13
(58) Field of Search ..... 271/9.13, 9.01, 271/9.07, 264, 275, 309

(56) References Cited

U.S. PATENT DOCUMENTS 3,341,195 A * 9/1967 Brandt et al. ..... 271/276
4,395,949 A * 8/1983 Jeschke ..... 101/420
5,086,698 A * 2/1992 Wirz ..... 101/409
5,398,925 A * 3/1995 Zeltner ..... 271/276
5,598,779 A * 2/1997 Haas et al. ..... 101/230
5,992,842 A * 11/1999 Dickhoff ..... 271/9.13
6,138,565 A * 10/2000 Koch et al. ..... 101/420
6,470,798 B1 * 10/2002 Hiwatashi et al. ..... 101/231
6,561,508 B2 * 5/2003 Helmstadter et al. ..... 271/226

FOREIGN PATENT DOCUMENTS

| | | | | |
|---|---|---|---|---|
| DE | 40 30 070 C2 | | 3/1992 | |
| DE | 41 40 762 A1 | | 6/1993 | |
| DE | 44 24 967 C2 | | 1/1996 | |
| DE | 44 24 970 C2 | | 1/1996 | |
| IT | 0 485 098 A1 | * | 5/1992 | B65H/3/44 |
| JP | 03143849 A | * | 6/1991 | B65H/5/26 |
| JP | 04064540 A | * | 2/1992 | B65H/3/44 |

* cited by examiner

*Primary Examiner*—Donald P. Walsh
*Assistant Examiner*—Joseph C. Rodriguez
(74) *Attorney, Agent, or Firm*—Laurence A. Greenberg; Werner H. Stemer; Ralph E. Locher

(57) ABSTRACT

A device for seperating copies of a flat sheet material mutally adjacently conveyed on paths defining a common wedge-shaped region, one of the copies of the flat sheet material passing over in a transfer region to the respective path whereon the other of the copies is conveyed, includes a guiding device for maintaining a seperation of the copies, said guiding device being accommodated in the wedge-shaped region; and a printing unit, a rotory printing machine and a multicolor rotory printing machine, respectively, having such a seperating device.

19 Claims, 7 Drawing Sheets

27
62
12
11
26
12.1
1
23
31
24
28
25
20
17
19
2
16
7
18
21
14
10

27
20
62
12
11
36
32.1
32'
12.1
1
34
32
33
24
35
6
32
28
2
16
30
7
21
14
10

1
2
6
7
12
12.1
36
37
37
38
38'
39
40
41
42
43
44
19
19
20
21
62

30
20
1
6
36
62
47
2
47
48
148
47
49
48
46
46'
46"
19
38
12
49
45

DEVICE FOR SEPARATING MUTUALLY ADJACENT FLAT COPIES

BACKGROUND OF THE INVENTION

Field of the Invention

The invention relates to a device for separating mutually adjacent flat copies which, for example, can be used in a reversing or turning device for reversing flat sheet material in a rotary printing machine.

The published German Patent Document DE 41 40 762 A1 is concerned with a sheet guiding device which may be used selectively, i.e., optionally, in recto and verso printing, it being possible, when operating in recto and verso printing mode, for the sheets to be reversed or turned in accordance with the principle of turning the sheet trailing edge, and the sheet guiding device includes pneumatically operating and mechanical devices disposed under an impression cylinder arranged upline from the reversing drum, as viewed in the travel direction of the sheets. In order to provide a sheet guiding device with which sheets can be guided and carried without smearing in the reversing or turning phase, without any formation of a sheet bulge, a guide doctor that can be acted upon pneumatically and is provided with individual air outlet openings is assigned to the impression cylinder at an angle of inclination β. After the grippers of the impression cylinder have opened, the printed sheet is released from the printing surface of the cylinder by blown or blast air, deflected under the guide plate and held high and transported in the direction towards the transfer cylinder by the emerging blown air, until the reversing drum conveys the sheet onwardly.

The published German Patent Document DE 44 24 967 C2 is concerned with a method and a device for reversing or turning sheets. A method is proposed for reversing or turning sheets according to the principle of turning the trailing edge in sheet-fed rotary printing machines that can be changed over from recto printing to recto and verso printing wherein, in recto and verso printing, a printed sheet carried on a cylinder is gripped at the trailing edge thereof and transported onwardly by a pivotable sheet transfer system of an reversing or turning drum disposed downline from the cylinder, at the tangent point of reversing or turning drum and the cylinder. At this tangent point, the starting end of the printed sheet is released by sheet grippers belonging to the cylinder and, immediately following the tangent point, is guided on a path under the reversing or turning drum, which differs from the surfaces of the cylinder.

The storage of sheet material on the impression cylinders of a rotary printing machine requires clearance underneath the impression cylinder in order to be able to accommodate the sheet material over the entire length thereof. Thus, the sheet can be gripped and reversed or turned by the reversing or turning drum without coming into contact with machine parts, jackets of transfer drums, guide plates or other sheets. The space requirement for storage conflicts with the requirement of having the sheet material printed out when it is transferred, in the recto printing mode, to the transfer drum following the printing cylinder. In recto printing, the sheet material has already left the printing nip at the time of the transfer. Therefore, in printing units having a single-drum reversing or turning device both between the transfer cylinder and the center line of the grippers of a downline transfer drum, as viewed in the travel direction of the sheets, and between the downline transfer drum and the transfer center line to the upline transfer drum, respectively, taking into account the space for collision with the installed fittings provided thereat, a complete length of the maximum printing format that can be processed has to be provided as a freely available sheet transport path. In addition, it is also necessary to take into account the requisite space required for accessibility and for installed fittings upline of the printing nip.

A further possibility for solving the technical problem indicated hereinbefore is to pivot the arrangement of the cylinders to such an extent that the overall space for printing out and storage is obtained at the cost of the installed fittings upline from the printing nip, as viewed in the travel direction of the sheets. By this measure, however, the quality of sheet guidance upline from the printing nip suffers, so that the print quality which is established becomes poorer. In addition, serious effects upon the accessibility to the installed fittings are to be feared. This makes more difficult the performance of cleaning work, the presentation of any settings which may have to be made, and the performance of service during maintenance work.

A further possible remedy is to restrict the permissible printing materials for the recto and verso printing mode to those papers which remain adhering to the circumference of the impression cylinder and which do not move away from the impression cylinder due to the influence of gravity and flexile rigidity. By this measure, the collision space to be kept free could be restricted, and the permissible format length could be increased. However, the restriction to only a few permissible printing materials for rotary printing machines with reversing or turning devices represents a severe impairment of the printing materials which can be processed, and can constitute only a compromise solution.

SUMMARY OF THE INVENTION

In view of the hereinafore outlined improvements known from the prior art and the hereinafore indicated technical problem, it is an object of the invention to provide a device for separating mutually adjacent flat copies wherein, for a given geometry, storable format length is extended.

With the foregoing and other objects in view, there is provided, in accordance with one aspect of the invention, a device for separating copies of a flat sheet material mutually adjacently conveyed on paths defining a common wedge-shaped region, one of the copies of the flat sheet material passing over in a transfer region to the respective path whereon the other of the copies is conveyed, comprising a guiding device for maintaining a separation of the copies, the guiding device being accommodated in the wedge-shaped region.

In accordance with another feature of the invention, the paths whereon the copies of the flat sheet material are conveyed are jacket surfaces of cylinders.

In accordance with a further feature of the invention, the path whereon one of the copies of the flat sheet material is conveyed is an enveloping curve of a transfer element formed with a setback contour.

In accordance with an added feature of the invention, the guiding device serves for performing an actuating movement for effecting a deflection of a following copy of the copies of the flat sheet material out of the path thereof.

In accordance with an additional feature of the invention, the separating device includes a device at an end of the guiding device for injecting separating air into the wedge-shaped region, the end of the guiding device being assigned to a transfer center line between the paths.

In accordance with yet another feature of the invention, the separating air is formed as free jets emerging from the tip of said guiding device.

In accordance with yet a further feature of the invention, separating elements of the separating air have a low flow velocity, and volume flows of the separating air are high.

In accordance with yet an added feature of the invention, the guiding device is formed as part of a storage device for accommodating a copy of the flat sheet material.

In accordance with yet an additional feature of the invention, the guiding device is part of a guide element located underneath a transfer element that is disposed upline from an impression cylinder.

In accordance with still another feature of the invention, the guiding device is constructed as a guide tongue movable translatorily into the wedge-shaped region in a direction towards a transfer center line.

In accordance with still a further feature of the invention, the guide tongue comprises a braking/catching hook at an end of the guide tongue facing towards the transfer center line.

In accordance with still an added feature of the invention, the guide tongue is formed with a planar surface and a curved surface, the curved surface facing towards a following copy of the copies of the flat sheet material.

In accordance with still an additional feature of the invention, the guiding device is adjustable from a rest position into a position wherein it deflects a following copy of the flat sheet material out of the path thereof, and extends into or across the path of the following copy of the copies of the flat sheet material.

In accordance with another feature of the invention, the guiding device is formed with a surface movable relative to a following copy of the copies, and including a cam control system via which the surface of the guiding device is activatable.

In accordance with a further feature of the invention, the guiding device is formed as a blowing element displaceable in a translatory direction and extending into or across the path of a following copy of the copies of the flat sheet material.

In accordance with an added feature of the invention, the guiding device is adjustable into an engaged position thereof wherein, by deflecting a following copy of the copies of the flat sheet material, a copy of the flat sheet material is stored in the path thereof above a storage device to beyond a transfer center line.

In accordance with an additional feature of the invention, the guiding device is formed with suction openings for attracting by suction and braking the copy of the copies of the flat sheet material passing the storage device.

In accordance with another aspect of the invention, there is provided a printing unit having a device for separating copies of a flat sheet material mutually adjacently conveyed on paths defining a common wedge-shaped region, one of the copies of the flat sheet material passing over in a transfer region to the respective path whereon the other of the copies is conveyed, comprising a guiding device for maintaining a separation of the copies, the guiding device being accommodated in the wedge-shaped region.

In accordance with a further aspect of the invention, there is provided a rotary printing machine having a device for separating copies of a flat sheet material mutually adjacently conveyed on paths defining a common wedge-shaped region, one of the copies of the flat sheet material passing over in a transfer region to the respective path whereon the other of the copies is conveyed, comprising a guiding device for maintaining a separation of the copies, the guiding device being accommodated in the wedge-shaped region.

In accordance with a concomitant aspect of the invention, there is provided a multicolor rotary printing machine having a device for separating copies of a flat sheet material mutually adjacently conveyed on paths defining a common wedge-shaped region, one of the copies of the flat sheet material passing over in a transfer region to the respective path whereon the other of the copies is conveyed, comprising a guiding device for maintaining a separation of the copies, the guiding device being accommodated in the wedge-shaped region.

The advantages that can be achieved with the invention can primarily be seen in the fact that an adjustable guiding device is provided in the wedge-shaped region which is defined by the paths of two copies of flat sheet material, the guiding device avoiding any contact between the two adjacently conveyed copies. As a result, the region for storing one of the copies on a path formed, for example, by a cylindrical circumferential jacket surface, may be expanded to such an extent that the storage space available for storing this copy of the flat sheet material can be extended beyond the transfer center line between the two axes formed, for example, by the cylindrical jacket surface of an impression cylinder or the cylindrical jacket surface of an upline cylinder or an enveloping curve of a transfer element that is formed with a setback contour and carries a flat sheet material. Damage to the mutually adjacently conveyed copies of the flat sheet material is prevented by maintaining the separation of the two copies from one another until they are in a region above the transfer center line. In a different embodiment of the principle upon which the invention is based, the adjacently conveyed copies can move on paths which, respectively, are formed by the circumferential jacket surfaces of cylinders which enclose a wedge-shaped region and carry the flat sheet material. On the other hand, the wedge-shaped region can also be formed between the circumferential jacket surface of a cylinder and an envelope curve of a transfer element formed with a setback contour and conveying flat sheet material.

If one of the components arranged in the wedge-shaped region and carrying flat sheet material is formed with a contour which is set back in relation to the enveloping curve thereof, the respective flat sheet copy conveyed on this component may advantageously be deflected out of the wedge-shaped region in a direction towards the center of the respective transfer component and, in this way, the collision-free region between the copies of the flat sheet material can be extended beyond the transfer center line, at which the two paths whereon the respective copies are carried meet.

In order to achieve the deflection of a following copy of the adjacently conveyed copies of the flat sheet material, the guiding device may be moved into a position which effects a deflection of the following copy and wherein the following copy can be deflected out of the path thereof corresponding to the enveloping curve. In order to maintain the separation of the two adjacently conveyed copies effectively in the wedge-shaped region between two meeting conveying paths, separating air can be injected into the wedge-shaped region through the end of the guiding device that is directed towards the transfer center line, and maintains the separation between the two copies of the flat sheet material conveyed adjacently in the wedge-shaped region. The separating air can emerge into the wedge-shaped region in the form of free jets, which emerge from the tip of the guiding device configured in accordance with the invention; the flow velocity of the air emerging from the guiding device is preferably selected so that it is low, and the emergent air volumes are selected to be high. As a result, quiet or steady flow can be achieved in the wedge-shaped region, due to which the tendency of the copies of the flat sheet material to flutter can be suppressed.

In another different embodiment of the concept upon which the invention is based, the guiding device can be part of a storage device, which accommodates a copy of the flat sheet material during reversing or turning, i.e., the reversal of the direction of movement, of this copy.

In addition, the guiding device can be constructed as a part of a guide element which can be pivoted away and which can be assigned underneath a transfer element formed with a setback contour, the transfer element being arranged upline of a cylinder. In a further different embodiment of the guiding device proposed by the invention, this may also be constructed as one which is movable translatorily, in a direction towards the transfer center line between the paths of the two copies of the flat sheet material. A guide tongue formed in this manner can comprise a braking hook or a catching hook at the end of the guide tongue facing towards the transfer center line. The guide tongue is preferably formed with a planar surface and a rounded or curved surface, the rounded surface facing towards the path of the copy of the flat sheet material, this path being described by the transfer element formed with the setback contour.

The guiding devices may advantageously be set from a rest position set back into the wedge-shaped region, into a position which deflects the following copy of the flat sheet material out of the conveying path, the path of the following copy of the copies of the flat sheet material being penetrated or crossed by the guiding device in the engaged position of the latter. The further that a deflection produced in this way of the following copy of the copies of the flat sheet material can be performed in the direction towards the transfer center line between the two meeting paths, the longer the storage space that is briefly available between the adjacently conveyed copies can be displaced in the direction towards the transfer center line.

The guiding device may furthermore be configured with entrained moving surfaces in the form of rotating rollers, which can, respectively, be activated by a cam control system. The cam control system that is used can be a driven four-bar linkage mechanism; in addition, a cam control system in the shape of a lever mounted in a sealed manner is conceivable, at one end of which a control roller that cooperates with a cam and rolls on the latter is rotatably held, while a supporting roller can be held at the other end of the centrally mounted lever.

The guiding device may additionally be formed as a blowing element configured in the shape of a mushroom and adjustable in translatory direction, and which penetrates or crosses the path of the following copy of the copies of the flat sheet material. For this purpose, the blowing element can be connected via a flexible line to a vacuum/blown air blower.

With each of the different embodiments of the device for separating mutually adjacently conveyed sheet material, as proposed in accordance with the invention, the maximum storable copy length of the flat sheet material can be enlarged, by making it possible for the storage operation, i.e., the placement of one of the copies of the flat sheet material on a cylindrical jacket surface formed by a cylinder, to be extended until above the transfer center line of the meeting paths of the two copies. As a result of maintaining a separation and, respectively, avoiding any tendency to flutter of the flat sheet material, contact between the adjacently conveyed copies can be effectively prevented. The separating device proposed in accordance with the invention may therefore be used particularly effectively on an reversing or turning device on rotary printing machines, wherein there is brief storage of a maximum processable format length as the flat sheet material has the direction of movement thereof reversed. Reversing or turning devices are preferably used on multicolor rotary printing machines which process both printing material of lower and of higher grammages and with higher or lower flexile rigidity (such as pasteboard or cardboard).

Other features which are considered as characteristic for the invention are set forth in the appended claims.

Although the invention is illustrated and described herein as embodied in a device for separating mutually adjacent flat copies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
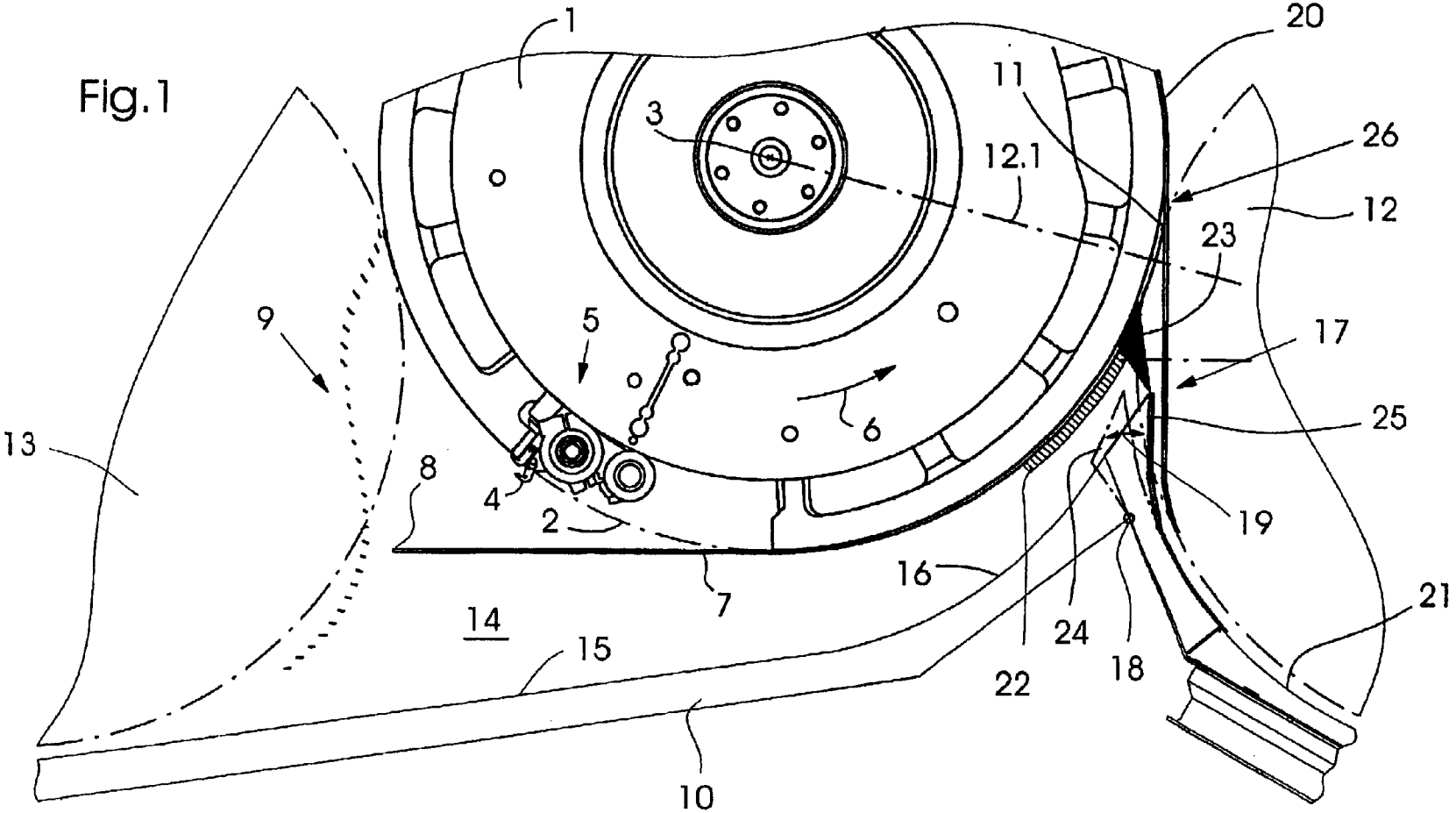
FIG. 1 is a fragmentary side elevational view of a printing press showing a blowing or blasting device constructed as a tip of a guide element, for injecting separating air into a wedge-shaped region, such as between two cylinders.

Referring now to the drawings and, first, particularly to FIG. 1 thereof, there is shown therein, in considerable detail, a blowing or blast-air device formed as a guide-element tip for injecting separating air into a wedge-shaped region located between cylinders, for example, and described by copies.

As shown in FIG. 1, an impression cylinder 1 having an outer cylindrical jacket surface 2 forms a conveying path of a copy 7 of a flat sheet material. The impression cylinder 1, as viewed in FIG. 1, rotates in a counterclockwise direction corresponding to that of the curved arrow 6 about a rotational axis 3 of the cylinder 1. Integrated in the cylindrical jacket surface of the impression cylinder 1 is a gripper 4 which is opened and closed by a gripper control system 5 reproduced only diagrammatically in the figure. A first sheet edge 8 of the copy 7 of the flat sheet material describes a path represented by a series of dashes identified by reference numeral 9. The path 9 extends parallel to a planar area 15 of a storage device 10 disposed underneath the impression cylinder 1. Arranged downline of the impression cylinder 1, as viewed in FIG. 1, is a transfer cylinder 13 which is illustrated only diagrammatically in the figure. Also associated with the impression cylinder 1 is an upline transfer element 12, which can either be a transfer cylinder constructed with a full jacket surface, or a transfer element which is provided with a gripping device which grips copies of a sheet material but has a contour that is set back with respect to an enveloping curve.

Reference numeral 11 identifies the position assumed by a second sheet edge of the copy of the flat sheet material on the path thereof formed by the jacket surface 2 of the impression cylinder 1. As is apparent from FIG. 1, the position 11 of the second sheet edge lies above a transfer center line 12.1, which is formed between the rotational axis 3 of the impression cylinder 1 and the non-illustrated axis of rotation of the transfer element 12 arranged upline from the impression cylinder 1. Above the transfer center line 12.1, a following or succeeding copy 20 of the flat sheet material passes over from the upline transfer element 12 to the jacket surface 2 of the impression cylinder 1. The storage device 10 includes a rising slope or incline 16 in addition to a planar flat area 15 which, in the wedge-shaped region, is defined by the impression cylinder 1 constructed with a full-surface form, and the upline transfer element 12 constructed, for example, with a setback contour. The rising slope 16 can be part of a guiding device. The tip 17 of the guiding device can be pivoted in the direction of the double arrow 19 about a pivot axis 18. The tip 17 of the guiding device can assume a first position 24 (rest position) shown in phantom, and an engaged or activated position 25 shown in solid lines. In the activated position 25, the tip 17 of the guiding device penetrates the enveloping curve (reproduced in phantom here) of the transfer element 12 with the setback contour, which is disposed upline from the impression cylinder 1. At the tip 17 of the guiding device, free separating-air jets 23 emerge which, on the one hand, favor the action of placing and holding the copy 7 of the flat sheet material on the cylindrical jacket surface 2 of the impression cylinder 1 and, on the other hand, inject an air wedge into the wedge-shaped region defined by the cylindrical jacket surface 2 and the enveloping curve of the upline transfer element 12. A guide element 21 is shown associated with the upline transfer element 12.

Figure 2:
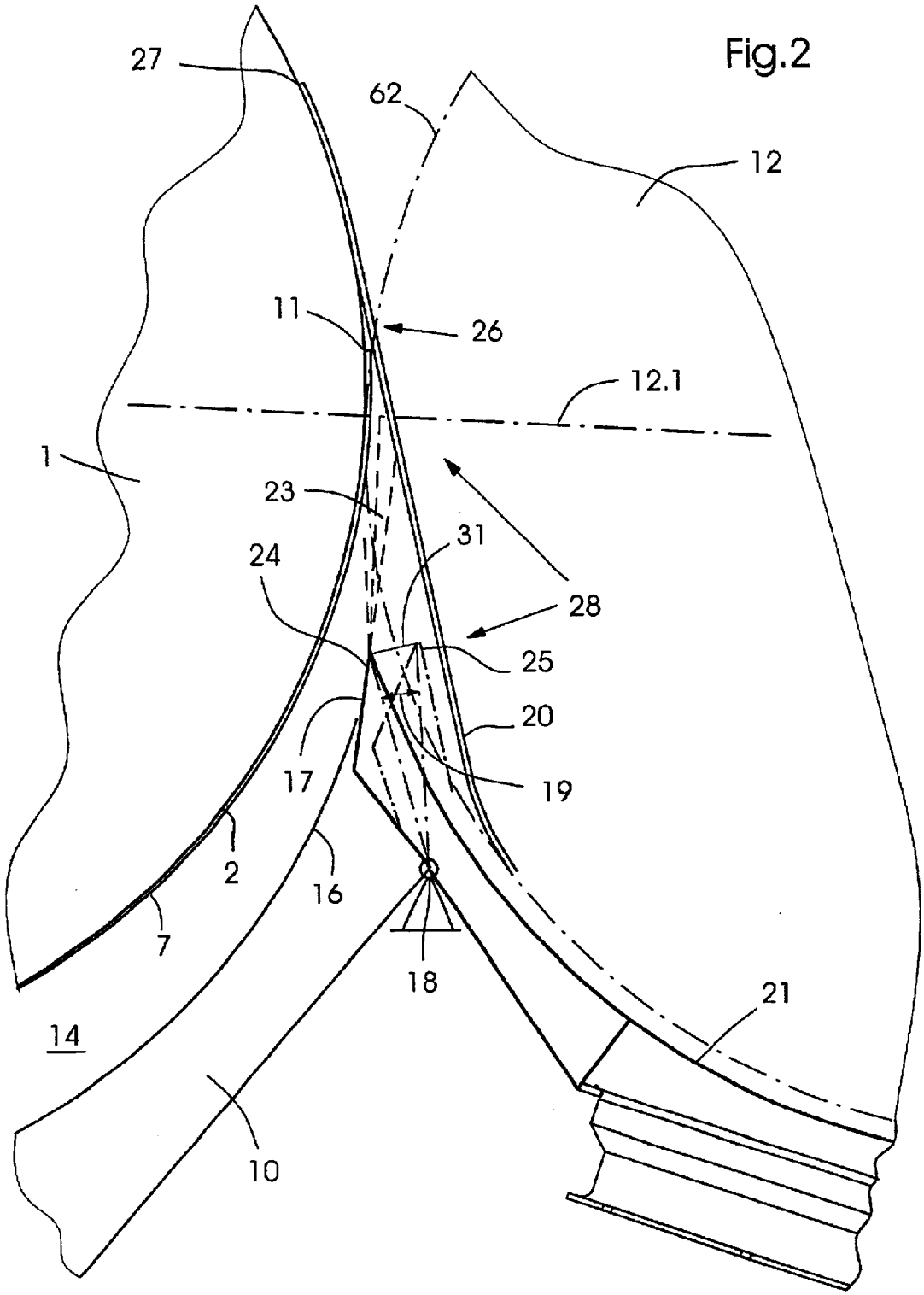
FIG. 2 is an enlarged fragmentary view of FIG. 1 showing the pivotable guide element tip in greater detail.

FIG. 2, in a scale that is enlarged with respect to that of FIG. 1, reveals in greater detail the pivotable guide-element tip 17 according to FIG. 1.

In the state illustrated in FIG. 2, the leading edge 27 of the following or succeeding sheet 20 has already passed over to the path formed by the cylindrical jacket surface 2 of the impression cylinder 1. The guide-element tip 17, which is pivotable into a rest position 24 and an engaged position 25 in accordance with the pivoting travel 19, is movable about the pivot axis 18. Even in the rest position 24 of the guide-element tip 17, the separating air 23 emerging from the tip 17 of the guiding device is able to achieve separation above the transfer center line 12.1 of the thereafter following copy 27 from the copy 7 of the flat sheet material lying on the circumferential jacket surface 2 of the impression cylinder 1. The enveloping curve 62 is described by a transfer element 12 disposed upline from the impression cylinder 1 and preferably formed with a setback contour. A guide element 21 is assigned to the transfer element 12 with the setback contour. In the rest position 24 of the guiding device 17, the slightly curved side thereof facing towards the upline transfer element 12 forms the outlet region of the guide element 21 underneath the transfer element 12 formed with the setback contour and disposed upline from the impression cylinder 1. In FIG. 2, the changeover or transfer region 26 is shown, within which the following copy 20 is forced back behind the enveloping curve 62 of the upline transfer element 12 by the guiding device 17 set into the engaged position 25, so that the effective storage length on the circumferential jacket surface 2 of the impression cylinder 1 can be enlarged briefly by avoiding contact between the copy 7 and the following copy 20. Within the transfer or changeover region 26, the following copy 20 deflected out of the path 62 thereof gradually leaves the upline transfer element 12 and changes over or passes to the circumferential jacket surface 2, i.e., the new path of the following copy 20 on the impression cylinder 1. By the pivoting movement represented by the double-headed arrow 19, the tip 17 of the guiding device describes a path 31 which depends upon the design geometry, i.e., the distance of the pivot axis 18 from the tip 17 of the guiding device.

Figure 3:
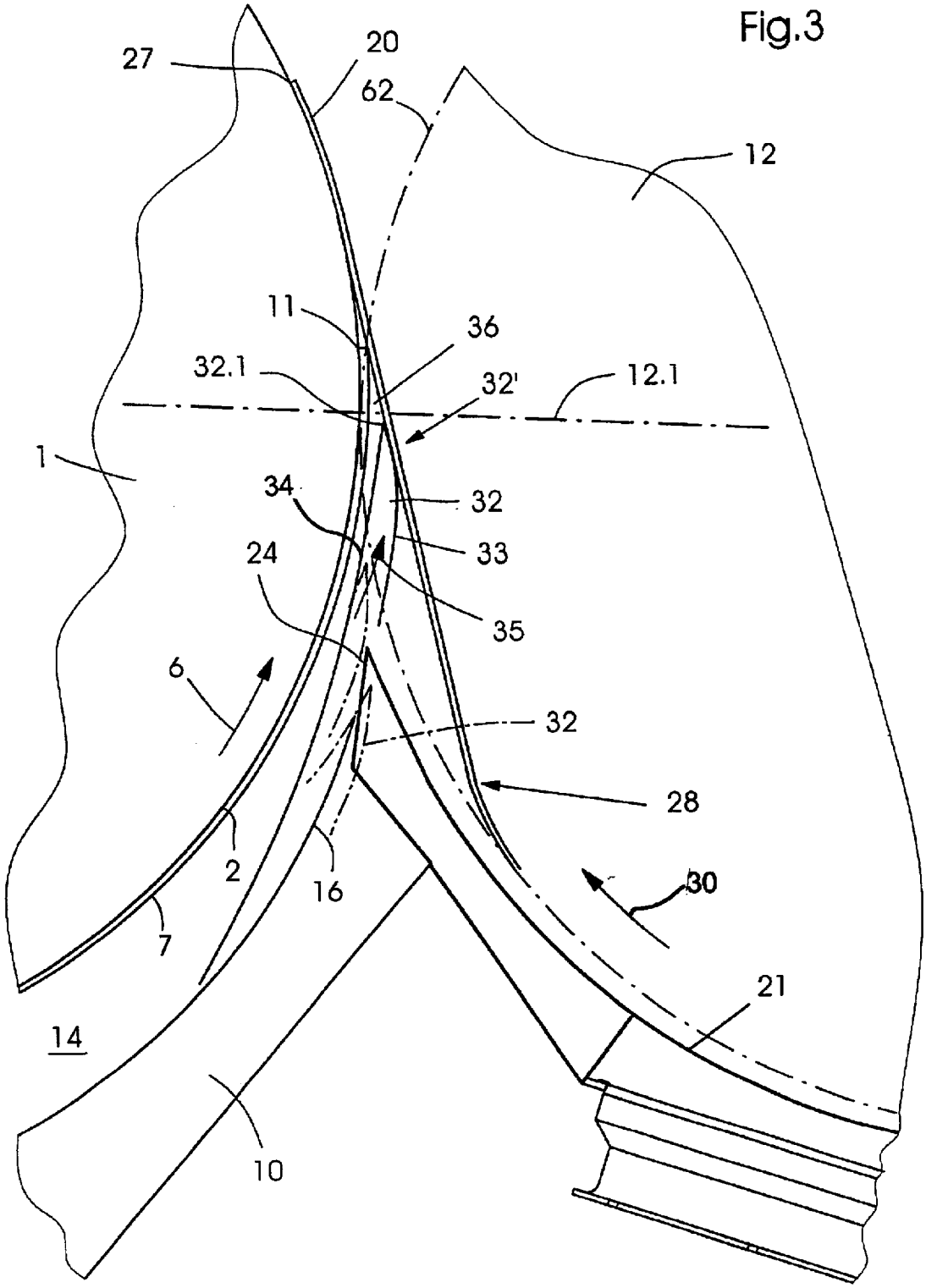
FIG. 3 is a view like that of FIG. 2 in another operating mode wherein a guide tongue is insertable translatorily into the wedge-shaped region.

FIG. 3 shows in greater detail a guide tongue that is insertable translatorily into the wedge-shaped region between two cylinders, for example.

In a different embodiment of the invention, according to FIG. 3, the guiding device proposed in the invention is constructed as an element engaging with the following or succeeding copy 20. A guide tongue 32 is displaceable in the direction of the arrow 35. A reference character 32' represents the engaged position of the translatorily displaceable guide tongue 32. Formed on the latter is a planar surface 34 assigned to the copy 7 which is held and stored on the cylindrical jacket surface 2 of the impression cylinder 1. A curved side 33 of the translatorily displaceable guide tongue 32 is illustrated as penetrating the enveloping curve 62 of the upline transfer element 12 when in the engaged position 32'. With the curved surface 33 of the guide tongue 32, the following copy 20 of the adjacently conveyed copies 7, 20 is guided on a collision-free path 28, which moves back behind the path defined by the enveloping curve 62 and described by the grippers carried on the upline transfer element 12. As a result, in the wedge-shaped region 36 above the transfer center line 12.1, separation is produced between the paths of the copy 7 on the cylindrical jacket surface 2 and the path 28 of the following copy 20. In FIG. 3, at the reference numeral 32 directed towards the phantom line, the guide tongue 32 is illustrated in a position thereof set back into a region of the storage device 10 and of the guide element 21, respectively. The upline transfer element 12 rotates in a clockwise direction represented by the curved arrow 30, while the impression cylinder 1 storing the copy 7 on the cylindrical jacket surface 2 thereof until the copy 7 is above the transfer center line 12.1 during the turning or reversing operation rotates in the counterclockwise direction 6. On the translatorily displaceable guide tongue 32, at the end facing the transfer center line 12.1, a catching hook or a braking hook 32.1 can be formed.

Figure 4:
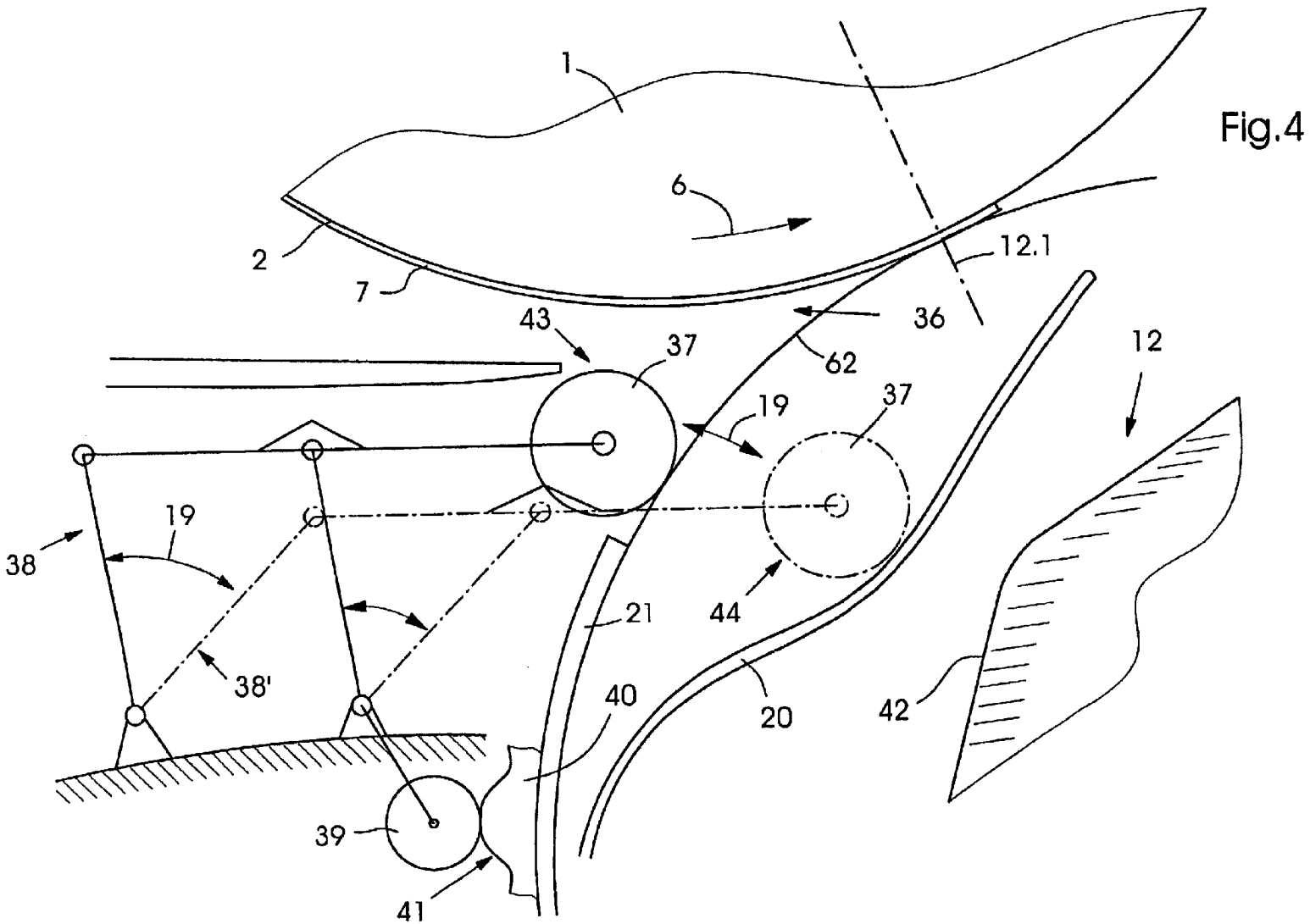
FIG. 4 is a view similar to that of FIG. 3, wherein an adjustable guide roller is disposed underneath a transfer center line.

FIG. 4 shows in greater detail, in a different embodiment, an adjustable guide roller 37 arranged underneath the transfer center line 12.1.

FIG. 4 illustrates the upline transfer element 12 with a setback contour 42 located opposite a cylinder 1 having a full cylindrical jacket surface 2. Between the setback contour 42 of the transfer element 12 disposed upline from the impression cylinder 1, for example, and the enveloping curve 62 thereof, which describes the conveying path of the undeflected following copy 20, on the one hand, and the cylindrical jacket surface 2 of the impression cylinder 1, which describes the conveying path of the copy of the sheet material to be stored, on the other hand, a wedge-shaped region 36 is formed. Between the axes of rotation of the impression cylinder 1 and of the transfer element 12 with the setback contour 42 disposed upline therefrom there is the transfer center line 12.1. In this different embodiment of the guiding device proposed by the invention, the guiding device comprises a guide roller 37, which is attached to a mechanism, constructed here as a four-bar linkage mechanism 38. The four-bar linkage mechanism 38 can be pivoted in the direction of the illustrated double-headed arrow 19, the pivoting movement being effected by a cam roller 39 attached to the four-bar linkage mechanism 38. The cam roller 39 rolls on the cam contour 41 of a cam 40 which, for example, can be accommodated in a stationary manner on the guide element 21. The guide element 21 which is assigned to the transfer element 12 disposed upline from the impression cylinder 1 and formed with the setback contour 42, is of stationary construction in the embodiment of FIG. 4. Due to the deflection movement according to the double-headed arrow 19, in accordance with the contour 41 predefined by the contour cam 40, the roller 37, constructed as a rotating, non-driven guide roller, moves into the clearance between the enveloping curve 62 and the setback contour 42 of the transfer element 12 disposed upline from the impression cylinder 1, and deflects the transfer element 12 out of the engaged position 44 thereof and out of the conveying path 62. A reference numeral 43 identifies the undeflected position of the adjustable guide roller 37. By deflecting the following copy 20 in this manner from the conveying path thereof bounding the wedge-shaped region 36 formed by the enveloping curve 62 of the upline transfer element 12 with the setback contour 42, contact can be avoided, on the other side of the transfer center line 12.1, with the leading edge of the copy of the flat sheet material held on the cylindrical jacket surface 2 of the impression cylinder 1. As a result, a greater area or region is briefly producible, wherein, on the path formed by the cylindrical jacket surface 2, a copy 7 can be stored during the reversing or turning operation.

Figure 5:
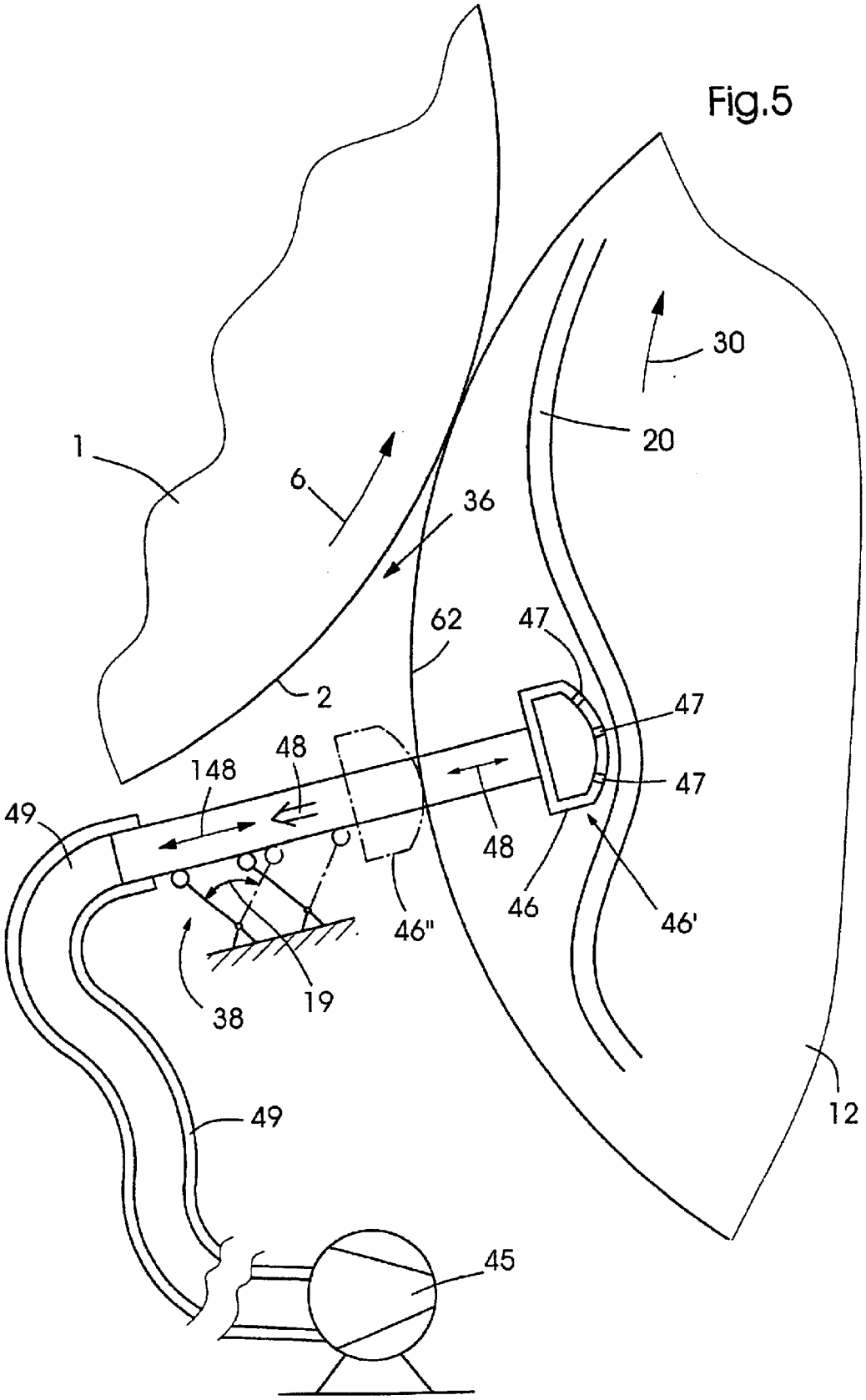
FIG. 5 is a view similar to that of FIG. 3, wherein a blowing or blasting element is movable into an enveloping curve of an upline transfer element having a setback contour.

FIG. 5 illustrates in greater detail, in a diagrammatic manner, a blowing or blast element 46 penetrating the enveloping curve 62 of an upline transfer element 12 with a setback contour 20.

The impression cylinder 1 according to the embodiment of FIG. 5 rotates in the counterclockwise direction represented by the arrow 6, while the transfer element 12 formed with a setback contour and disposed upline from the impression cylinder 1 rotates in the clockwise direction represented by the arrow 30. The blowing or blast element 46 that executes a translatory actuating movement 48 is fixed to a mechanism, constructed, for example, as a four-bar linkage system 38. On the side thereof facing towards the following copy 20, the blowing or blast element 46 has a row of blowing air or blast openings 47. The blast element 46 is connected via a flexible feed line 49 to a vacuum/blowing air blower 45, so that the translatory setting movement penetrating the enveloping curve 62 of the upline transfer element 12 can perform a deflecting movement without contact. The double-headed arrow 148 indicates both possible flow directions of the air by which the sheet 20 can both be guided without contact by the emergence of air and can also be braked and tautened by friction due to the application of suction. The mushroom-like blast element 46 can also be the sheet material itself.

A reference character 46" identifies the inactive position of the blast element 46 which is configured in a mushroom shape, in which position the latter is set outside the enveloping curve 62 of the upline transfer element 12 formed with a setback contour. A reference character 46' identifies the engaged position of the blast element 46.

Figure 6:
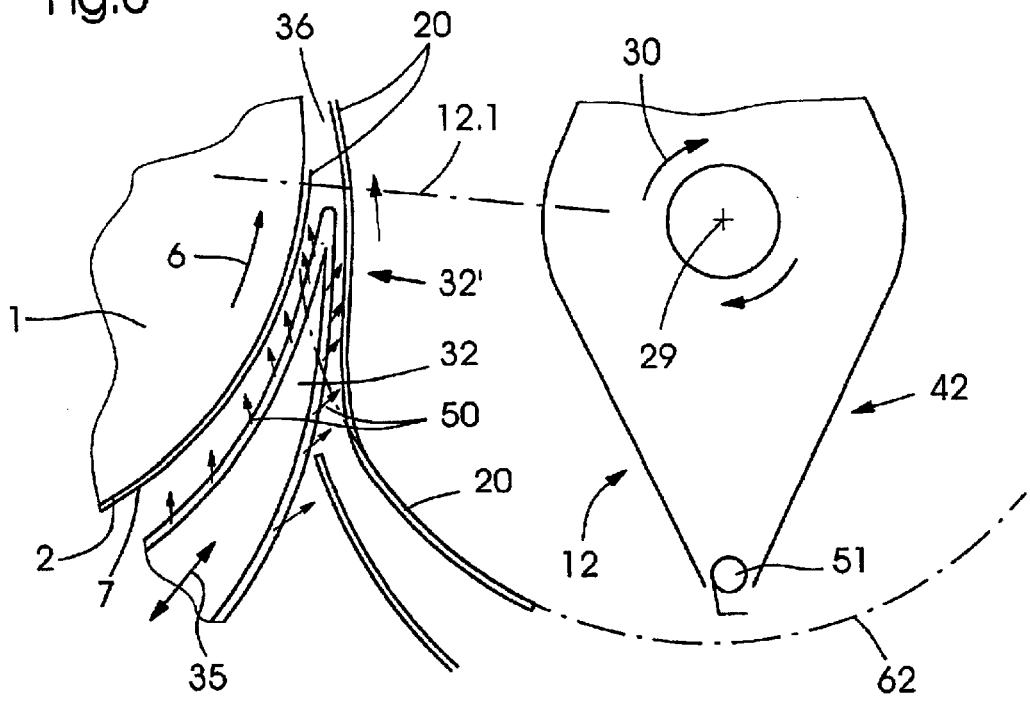
FIG. 6 is a reduced view similar to that of FIG. 3, showing another embodiment of the guide tongue formed with blown or blast-air free jets emerging on both sides thereof.

FIG. 6 illustrates in greater detail a guide tongue according to FIG. 3, but from which blown air-free jets emerge on both sides thereof.

In FIG. 6, the path 2 whereon a copy 7 of the flat sheet material is carried and stored is formed by the cylindrical or circumferential jacket surface 2 of an impression cylinder 1. In the wedge-shaped region 36, the impression cylinder 1 cooperates with an upline transfer element 12, which rotates in the clockwise direction represented by the arrow 30 about the rotational axis 29. The upline transfer element 12 is preferably constructed with a setback contour 42 and, at an opposite end thereof, respectively, has gripping devices 51 which grip the following copy 20. During the rotation of the upline transfer element with the setback contour 42 about the rotational axis 29, the gripping devices 51 describe an enveloping curve 62. By an engaging movement performed in the direction of the double-headed arrow 35, the guide tongue element 32 can be introduced into the wedge-shaped region 36 or moved out of the latter. In contrast with the illustration of the guide tongue according to FIG. 3, blown air-free jets emerge from the curved side surfaces of the guide tongue 32 and, on the one hand, ensure that the copy 7 following the path rests on the circumference of the impression cylinder 1 until it is in a region above the transfer center line 12.1 and, on the other hand, cause the deflection of the following copy 20 from the path thereof defined by the enveloping curve 32. Deflecting the following copy 20 on a collision-free path 28 means that, above the transfer center line 12.1, the copies 7 and 20 following the different paths thereof remain separated from one another and do not touch one another. The blown air emergence from the side surfaces of the guide tongue 32 is identified by reference numeral 50. The second sheet edge 11 of the copy 7 in the embodiment according to FIG. 6 is arranged lying above the transfer center line 12.1; the following copy 20 is conveyed past the sheet edge 11 of the copy 7 without contact.

Figure 7:
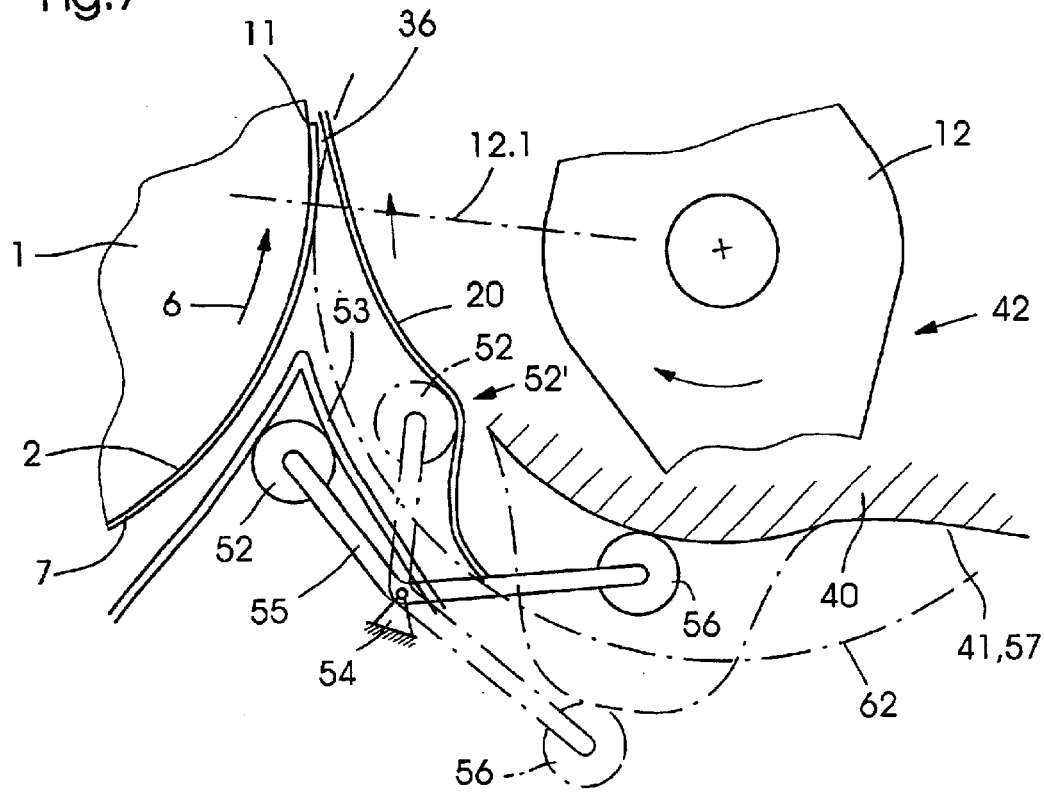
FIG. 7 is a view similar to that of FIG. 6, showing a supporting roller which is movable into an enveloping curve of an upline transfer element formed with a setback contour.

FIG. 7 illustrates in greater detail a supporting roller that can be moved into the enveloping curve of an upline transfer element formed with a setback contour.

A supporting roller 52 is held pivotably on a lever 55. The lever 55 is supported centrally by a lever bearing 54. At the end of the lever 55 that is directed away from the wedge-shaped region 36, a cam roller or follower 56 is mounted which cooperates with a cam 40 held in a stationary position. The cam 40 has a cam contour 41 and 57 and imparts to the supporting roller arrangement 52 rotatably held on the opposite lever end an engaging or activating translatory movement 52'. Also in the embodiment according to FIG. 7, the transfer element upline of the impression cylinder 1 is formed with a setback contour 42, so that a clearance is provided between the enveloping curve 62 thereof and the setback contour 42, the supporting roller 52 dipping into that clearance when in the activated state 52'. In the state identified by the reference character 52', the following copy 20 has been deflected out of the path thereof originally defined by the enveloping curve 62 so that it follows but does not touch the leading edge 11 of the sheet material 7 which is following on the path formed by the cylindrical or circumferential jacket surface 2 of the impression cylinder 1. In the inactive state of the supporting roller 52, the latter is moved back into the interior of a guide element 53, which is adjoined by the guide element 21 (not shown here), but is assigned to the transfer element 12 disposed upline from the impression cylinder 1. If the guiding devices according to FIGS. 4 and 7 are constructed as the rollers 52 and 37 which can be moved in relation to the following copy 20, the result is the advantage that the surface of the following copy 20 cannot be scratched, nor can any marking phenomena occur thereon as a result of depositions of ink or transfer of ink.

Figure 8:
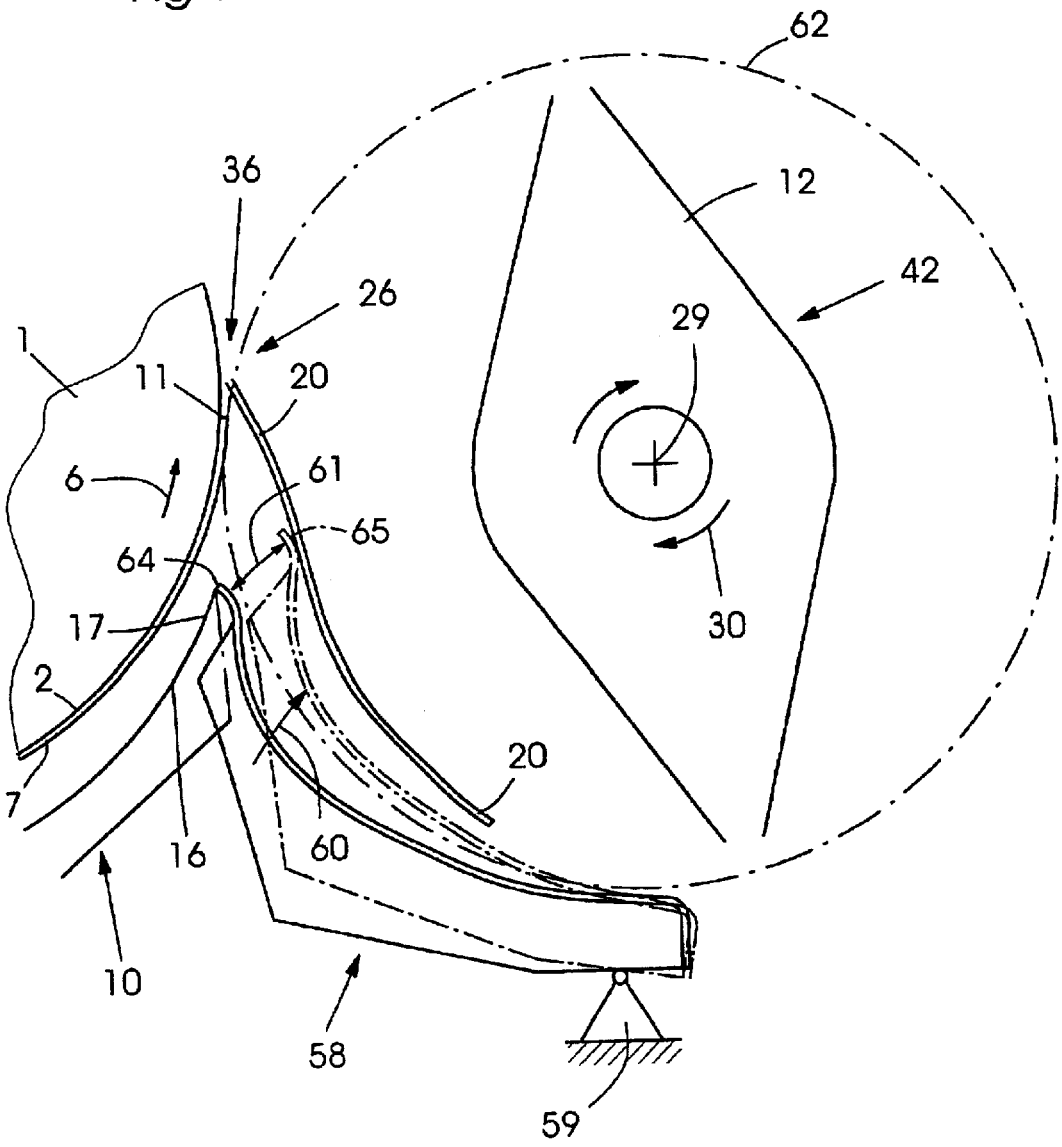
FIG. 8 is a view similar to that of FIG. 7, showing a pivotable guide surface arranged underneath an upline transfer element.

FIG. 8 illustrates in greater detail a pivotable guide surface arranged underneath the upline transfer cylinder.

In a different embodiment according to FIG. 8, the transfer element 12 arranged upline from the impression cylinder 1 is also formed with a recessed contour 42. The gripping devices 51 accommodated on the latter in a manner analogous to the embodiment of FIG. 6 describe the enveloping curve identified by reference numeral 62. The upline transfer element 12 rotates in the clockwise direction 30 about the rotational axis 29 thereof, while the rotating impression cylinder 1 rotates in the counterclockwise direction about the rotational axis 3 thereof, not shown in this figure.

In FIG. 8, the storage device 10 underneath the cylindrical jacket surface 2 of the impression cylinder 1 and the guiding device 21 assigned to the upline transfer element are constructed as one component, a partial surface 28 of the guide element 21 assigned to the upline transfer element 12 being held so that it can pivot on a bearing 59. The pivoting movement of the pivotable guide surface 58 is identified by reference numeral 60. The path traced during the pivoting operation is indicated by the double-headed arrow 61. The inactive position of the pivotable guide surface 58 is identified by reference numeral 64, so that in the inactive position of the pivotable surface 58, the upper edge thereof coincides with the tip 17 of the guiding device. In the engaged state 65, reproduced in phantom, the guide surface 58 is set into a position penetrating the enveloping curve 62 of the upline transfer element with the setback contour 42. In this position, the rounded area of the guide surface 58 rests on the following copy 20, deflects the latter out of the conveying path 62 thereof and prevents it from contacting the sheet edge 11 of the copy 7 which is following the path 2 on the impression cylinder 1, above the transfer center line, which is not specifically illustrated here. With this embodiment of the concept upon which the invention is based, it is also possible for the maximum storable format length to be increased considerably, the storage operation of the sheet material 7 to be reversed or turned on the circumferential surface 2 of the impression cylinder 1 being expanded briefly beyond the transfer center line, without having to fear any damage to the copies 7, 20 resulting from the contact thereof and from the fluttering thereof, respectively.

The guide element 17 provided by the invention can be constructed with additional elements to ensure the reversing or turning process, for example, with a catching or capturing element for lost copies or a monitoring sensor.

I claim:

1. A turning device in a sheet-processing machine, the device comprising:

a first transfer element and a second transfer element associated with said first transfer element, said transfer elements having rotational axes defining a transfer center line therebetween;

paths formed on said first and second transfer elements for mutually adjacently conveying copies of flat sheet material on said paths, said paths defining a common wedge-shaped region below said transfer center line, and said paths being jacket surfaces of cylinders;

a transfer region formed above said transfer center line, one of the copies of the flat sheet material on one of said paths being passed over at said transfer region to an other of said paths whereon another of the copies is conveyed; and a guiding device accommodated in said wedge-shaped region for maintaining a separation of the copies.

2. The turning device according to claim 1, wherein said guiding device is part of a guide element located underneath one of said transfer elements disposed upline from an impression cylinder.

3. The turning device according to claim 1, wherein one of said paths is an enveloping curve of one of said transfer elements formed with a setback contour.

4. The turning device according to claim 1, wherein said guiding device serves for performing an actuating movement for effecting a deflection of a following copy of the copies of the flat sheet material out of said path thereof.

5. The turning device according to claim 1, including a device at an end of said guiding device for injecting separating air into said wedge-shaped region, said end of said guiding device being assigned to said transfer center line.

6. The turning device according to claim 5, wherein said device at said end of said guiding device is a tip and said separating air is formed as free jets emerging from said tip.

7. The turning device according to claim 5, wherein a flow velocity of said separating air is low, and volume flows of said separating air are high.

8. The turning device according to claim 1, wherein said guiding device is formed as part of a storage device for accommodating a copy of the flat sheet material.

9. The turning device as claimed in claim 8, wherein said guiding device is formed with suction openings for attracting by suction and braking the copy of the copies of the flat sheet material passing the storage device.

10. The turning device according to claim 1, wherein said guiding device is constructed as a guide tongue movable translatorily into said wedge-shaped region in a direction towards a said transfer center line.

11. The turning device according to claim 10, wherein said guide tongue includes a catching hook at an end of said guide tongue facing towards said transfer center line.

12. The turning device as claimed in claim 10, wherein said guide tongue is formed with a planar surface and a curved surface, said curved surface facing towards a following copy of the copies of the flat sheet material.

13. The turning device according to claim 1, wherein said guiding device is adjustable from a rest position into a position wherein it deflects a following copy of the flat sheet material out of said path thereof, and extends into said path of the following copy of the copies of the flat sheet material.

14. The turning device according to claim 1, wherein said guiding device is formed with a surface movable relative to a following copy of the copies, and including a cam control system via which said surface of said guiding device is activatable.

15. The turning device according to claim 1, wherein said guiding device is formed as a blowing element displaceable in a translatory direction and extending into said path of a following copy of the copies of the flat sheet material.

16. The turning device according to claim 1, wherein said guiding device is adjustable into an engaged position, a copy of the flat sheet material is stored in said path thereof up to a location beyond a said transfer center line by deflecting a following copy of the flat sheet material in said engaged position of said guiding device.

17. A multicolor rotary printing machine, comprising a turning device for transferring copies of a flat sheet material, the device including:

a first transfer element and a second transfer element associated with said first transfer element, said transfer elements having rotational axes defining a transfer center line therebetween;

paths formed on said first and second transfer elements for mutually adjacently conveying the copies of the flat sheet material on said paths, said paths defining a common wedge-shaped region below said transfer center line, and said paths being jacket surfaces of cylinders;

a transfer region formed above said transfer center line, one of the copies of the flat sheet material on one of said paths being passed over at said transfer region to an other of said paths whereon another of the copies is conveyed; and a guiding device accommodated in said wedge-shaped region for maintaining a separation of the copies.

18. A printing unit, comprising a turning device for transferring copies of a flat sheet material, the device including:

a first transfer element and a second transfer element associated with said first transfer element, said transfer elements having rotational axes defining a transfer center line therebetween;

paths formed on said first and second transfer elements for mutually adjacently conveying the copies of the flat sheet material on said paths, said paths defining a common wedge-shaped region below said transfer center line, and said paths being jacket surfaces of cylinders;

a transfer region formed above said transfer center line, one of the copies of the flat sheet material on one of said paths being passed over at said transfer region to an other of said paths whereon another of the copies is conveyed; and a guiding device accommodated in said wedge-shaped region for maintaining a separation of the copies.

19. A rotary printing machine, comprising a turning device for transferring copies of a flat sheet material, the device including:

a first transfer element and a second transfer element associated with said first transfer element, said transfer elements having rotational axes defining a transfer center line therebetween;

paths formed on said first and second transfer elements for mutually adjacently conveying the copies of the flat sheet material on said paths, said paths defining a common wedge-shaped region below said transfer center line, and said paths being jacket surfaces of cylinders;

a transfer region formed above said transfer center line, one of the copies of the flat sheet material on one of said paths being passed over at said transfer region to an other of said paths whereon another of the copies is conveyed; and a guiding device accommodated in said wedge-shaped region for maintaining a separation of the copies.

* * * * *